US005435524A

United States Patent [19]

Ingram

[11] Patent Number: 5,435,524

[45] Date of Patent: Jul. 25, 1995

[54] IMPACT FENCE

[76] Inventor: L. Howard Ingram, P.O. Box 363, Forest Grove, Oreg. 97116

[21] Appl. No.: 163,293

[22] Filed: Dec. 6, 1993

[51] Int. Cl.[6] ..... E01F 7/04

[52] U.S. Cl. ..... 256/12.5; 256/35

[58] Field of Search ..... 256/12.5, 13.1, 23, 256/25, 35; 188/65.1–65.4; 244/110 C, 110 F; 403/396, 398

[56] References Cited

U.S. PATENT DOCUMENTS

| | | | |
|---|---|---|---|
| 1,579,005 | 3/1926 | Krout | 403/396 |
| 2,692,376 | 10/1954 | Van Dusen | 403/396 X |
| 2,956,323 | 10/1960 | Stoeltzlen | 403/398 X |
| 3,200,906 | 8/1965 | Bernard | 188/65.1 |
| 4,730,810 | 3/1988 | Rambaud | 256/12.5 |
| 4,819,915 | 4/1989 | Cargnel | 256/12.5 |
| 5,199,673 | 4/1993 | Bollinger . | |

FOREIGN PATENT DOCUMENTS

| | | | |
|---|---|---|---|
| 2412008 | 7/1979 | France . | |
| 2414586 | 8/1979 | France . | |
| 2107233 | 8/1971 | Germany | 256/12.5 |

OTHER PUBLICATIONS

"Safety Nets by Brugg," Brugg Cable Products, Inc., 16-page brochure (undated).

*Primary Examiner*—Anthony Knight
*Attorney, Agent, or Firm*—Klarquist, Sparkman, Campbell, Leigh & Whinston

[57] ABSTRACT

An impact fence including an expanse of chain link fencing supported on a plurality of spaced posts. An elongate cable assembly extends between the posts, and the fencing is connected to the cable assembly. The cable assembly includes cable portions formed in loose curves with friction-braking devices resisting movement of such cable portions toward straight-line configuration. The friction-braking devices are in pairs mounted outside opposite sides of the curves and are connected to a holding device which maintains selected spacing between the braking devices.

20 Claims, 2 Drawing Sheets

FIG. 3
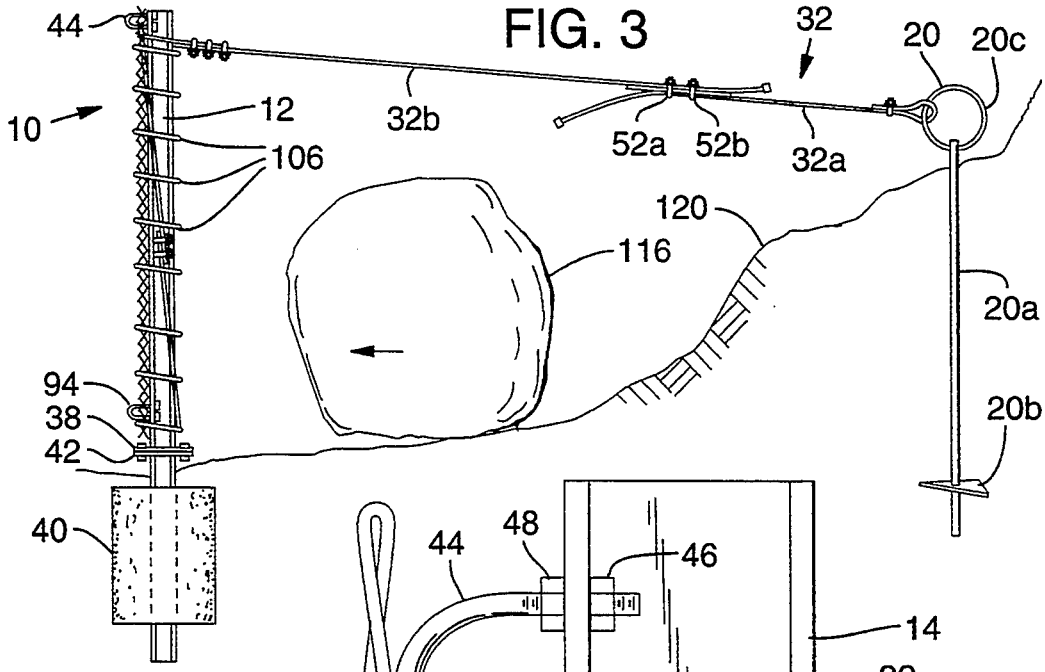
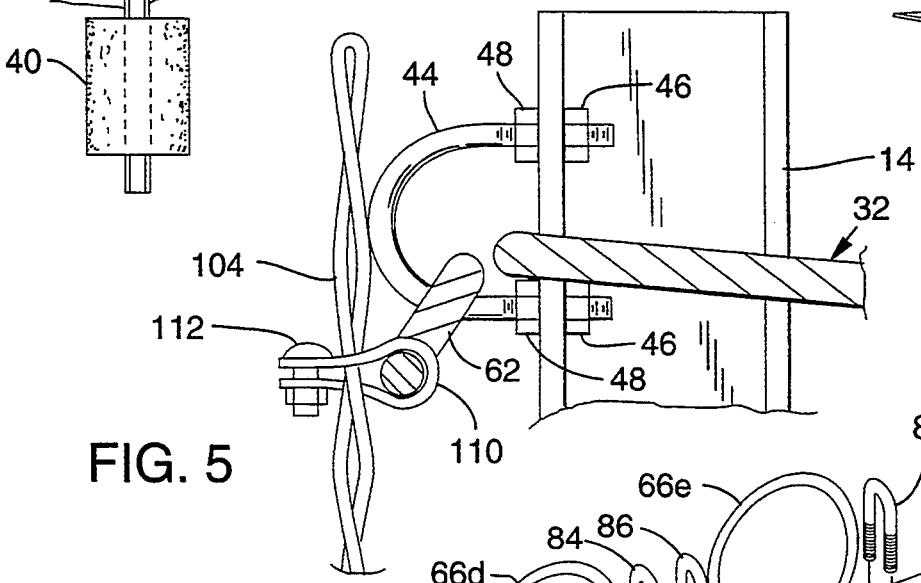
FIG. 5
FIG. 4
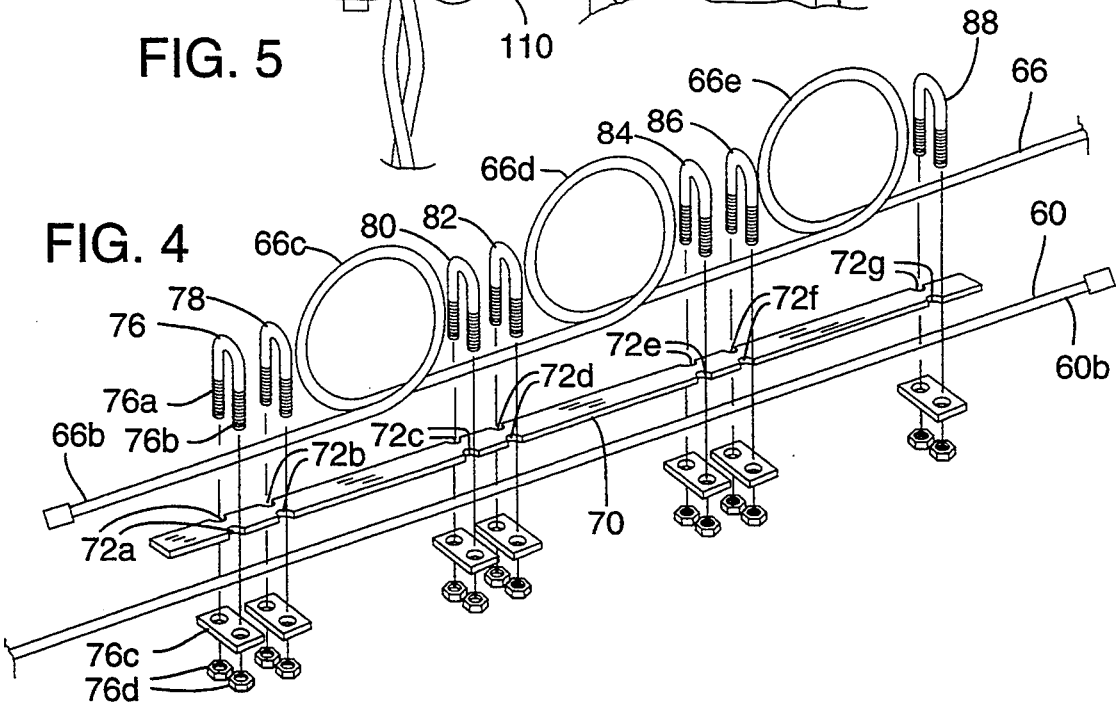

IMPACT FENCE

This invention relates to an impact fence, and more particularly to such fence as may be used to resist impact loading from such occurrences as rock falls or snow avalanches.

BACKGROUND AND SUMMARY OF THE INVENTION

In the past, various types of impact fences have been produced using a variety of fencing and support mechanism. Many of these have included netting made of interlocking cable strands which, although effective, are very expensive to produce, install, and maintain. Prior attempts at using a less expensive material, such as standard chain link fencing, have, for the most part, been unsuccessful, in that the support systems used for the chain link fencing have been inadequate to resist or withstand sufficient loading upon impact being imposed thereagainst.

A general object of the present invention is to provide a novel impact fence which uses inexpensive materials, such as chain link fencing, yet is constructed in such a manner that it is capable of absorbing high-impact loads, and is economical to construct and maintain.

Yet another object is to provide such an impact fence which has cable assemblies for mounting the chain link fencing, which cable assemblies include novel friction-braking devices, with loose, curved portions of the cable intermediate friction-braking devices to provide controlled absorption of impact imposed upon the fence.

These and other objects and advantages will become more fully apparent as the following description is read in conjunction with the drawings described below.

BRIEF DESCRIPTION OF THE DRAWINGS

FIG. 3 is an enlarged detailed elevation view of a portion of the fence taken generally along the line 3—3 in FIG. 1;

FIG. 4 is an enlarged exploded view of a portion of a cable assembly supporting the fence, with friction-braking and holding devices shown disassembled;

FIG. 5 is an enlarged cross-sectional view, taken generally along the line 5—5 in FIG. 2, of the upper end of a post and the mounting of fencing material thereon.

DESCRIPTION OF PREFERRED EMBODIMENT

Figures 1, 2, 6, 7:
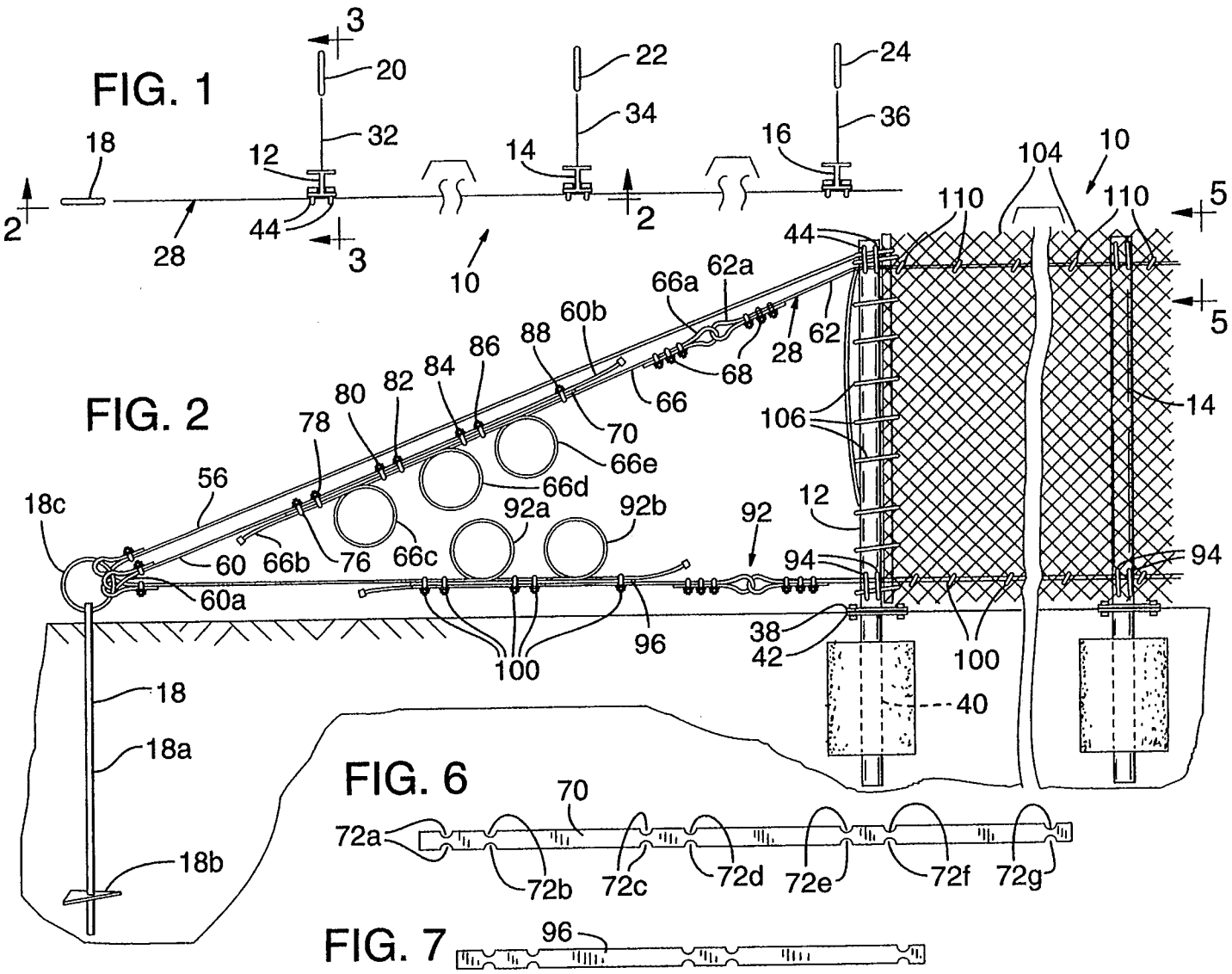
FIG. 1 is a schematic top plan view of a portion of an impact fence constructed according to an embodiment of the invention.
FIG. 2 is a more detailed elevation view of a portion of a fence taken generally along the line 2—2 in FIG. 1.
FIGS. 6 and 7 are top plan views of holding bars used in the friction-braking system.

Referring to the figures, and first more particularly to FIG. 1, at 10 is indicated schematically an impact fence constructed according to an embodiment of the invention. It includes a plurality of spaced- apart, upright support posts 12, 14, 16. A plurality of anchors 18, 20, 22, 24 are spaced from the posts. Anchor 18 is spaced outwardly, in line with the posts, whereas supports 20, 22, 24 are spaced on the uphill sides of and aligned with post 12, 14, 16, respectively.

A cable assembly 28 is illustrated schematically in FIG. 1 extending from anchor 18, along the front, or downhill, sides of posts 12, 14, 16. Similarly, transverse support cable systems 32, 34, 36 are illustrated schematically extending between posts 12, 14, 16 and anchors 20, 22, 24, respectively.

The support posts are all similar, and thus only one will be described in detail. Referring to post 12, it includes an upright, wide-flange I-beam member having a bolt flange 38 secured to its lower end. An anchor member 40 embedded in support medium, such as the ground, has a like bolt flange 42 secured to its upper end through which post 12 and anchor 40 may be releasably secured to each other by a series of bolts extending through the flanges.

Referring to FIG. 5, the upper end of support post 12 has a pair of vertically spaced bores extending therethrough into which a U-bolt 44 extends with nuts 46, 48 on its inner and outer ends, respectively, securing the U-bolt to the post.

Referring to FIG. 2, anchor 18 is illustrative of other anchors used herein. It will be seen that it is a rod style screw anchor having a central rod portion 18*a*, and a lower end plate 18*b* which will auger the anchor into the ground as it is turned. A ring 18*c* is held atop rod portion 18*a*. FIG. 3 illustrates an anchor 20 with similar component parts 20*a*, 20*b*, 20*c*, respectively.

Referring still to FIG. 3, a transverse support cable system 32 includes a first cable section 32*a* connected at one of its ends to anchor ring 20*c*, and another cable section 32*b* connected to the top of post 12. The adjacent and overlapping portions of cable sections 32*a*, 32*b* have a pair of U-bolt style cable clamps 52*a*, 52*b* mounted thereon which frictionally engage the overlapping portions of 32*a*, 32*b* to frictionally hold them in position, but allow some movement therebetween upon severe impact loads being imposed on the fence as will be described below.

Anchor 18 is spaced outwardly from the end of the line of support posts. A fixed length cable 56 is secured at one end to anchor ring 18*c*, and at its other end to the upper end of post 12 to provide a guying support for the post.

A first fence support cable assembly is indicated generally at 28 as previously noted. This cable assembly includes an elongate cable section 60 having its end 60*a* connected to anchor ring 18*c* and its opposite end 60*b* terminating short of post 12. Another elongate cable section, which also forms a part of cable assembly 28, is indicated at 62. The major portion of the length of cable section 62 extends between and is supported by U-bolts, such as that indicated generally at 44 in FIGS. 2, 3 and 5, secured adjacent the upper ends of the support posts.

A further cable section 66 forms another part of cable assembly 28. One end 66*a* of cable section 66 is connected to end 62*a* of cable 62 through known cable clamp attachments. The opposite end 66*b* of cable section 66 terminates adjacent anchor 18. Intermediate portions of cable section 66 are formed in three loose curves, or loops, 66*c*, 66*d*, 66*e*. These loops are best illustrated in FIGS. 2 and 4.

An elongate, rigid, holding device in the form of a bar 70 is interposed between, and extends longitudinally of cables 60, 66 in the region of loops 66*c*, 66*d*, 66*e*. Referring to FIGS. 4 and 6, bar 70 is longer than the space between the ends of loops 66*c*, 66*d*, 66*e* and has a plurality of spaced-apart indentations, or openings, along its opposite side margins in pairs noted *72a, 72b, 72c, 72d, 72e, 72f, 72g.*

A plurality of U-bolt style friction braking devices 76, 78, 80, 82, 84, 86, 88 extend about cables 60, 66, and bar 70 to provide frictional holding of the cables relative to each other. As is seen each U-bolt friction-braking device, and referring specifically to 76, includes a U-bolt having legs (such as *76a, 76b*) which are threaded adjacent their lower ends, a plate (*76c*) having bores extending therethrough to receive the legs (*76a, 76b*) and a pair of nuts (*76d*) to screw onto the legs (*76a, 76b*). Legs *76a, 76b* when extended about cable 60, 66 with bar 70 therebetween rest in indentations *72a,* which secures U-bolt friction-braking device 76 against movement relative to bar 70.

The other U-bolt friction-braking devices 78, 80, 82, 84, 86, 88 similarly fit about cables 60, 66 and rest in indentations in the side margins of bar 70 whereby their movement relative to the bar is restricted.

Referring to FIGS. 2 and 4, a pair of U-bolt friction-braking devices 78, 80 are spaced outwardly to opposite sides of curve, or loop, *66c;* a pair of U-bolt friction-braking devices 82, 84 are spaced outwardly to opposite sides of loop, or curve, *66d;* and a pair of U-bolt friction-braking devices 86, 88 are spaced outwardly to opposite sides of loop, or curve, *66e.* Likewise, the various pairs of U-bolts associated with each of the loops are held in selected spaced relation to each other by the holding device, or bar 70.

It should be recognized, as will be described in greater detail below, that the degree to which each of these U-bolt friction-braking devices is tightened onto the cables by the operation of the nuts thereon will determine the friction holding force resisting movement of cables 60, 66 relative to each other.

A second cable assembly 92, substantially similar to that described above for cable assembly 28, has one end thereof connected to anchor 18 and extends through U-bolts 94 connected to the lower ends of the support posts.

One minor difference in relation to cable assembly 92, it is that it includes only two loops, or curves, *92a, 92b* rather than the three provided for cable assembly 28. In FIG. 7, it will be seen that its holding device, or bar 96, has fewer indentations in the side margins thereof, since fewer U-bolt friction-braking devices 100 are provided.

An elongate, substantially planar, expanse of chain link fencing material 104 is secured adjacent one of its ends to post 12, and extends along the front, or downhill, sides of the support posts. A plurality of cable wraps 106 secure one end of the fencing material to post 12.

Intermediate remainder portions of fencing 104 are connected to and supported on upper cable assembly cable 62 and lower cable assembly 92. The interconnection between the cables and chain link fencing is provided by clamps such as that indicated at 110 in FIG. 5. The clamp has a U-shape portion which extends loosely about its associated cable, such as 62 in FIG. 5, and legs which extend through the wire mesh of the chain link fencing. A bolt and nut 112 extending through outer end portions of the clamp secure the clamp legs together to support the chain link fencing 104 on its associated cable. The chain link fencing thus is supported in a substantially upright position on the support posts, yet it has the ability to move somewhat relative to the posts to absorb initial impact shock loads.

To provide an example of components which have been found to work well to absorb impact loads from falling, or rolling, rocks such as may occur on hillsides where protection from falling or rolling rocks is to be provided, the upright posts may be 6×9-inch wide-flange beams 6 feet or more in height. The chain link fencing is of substantially common manufacture constructed of intertwined 6-gauge wire approximately 6 feet or more in height. The cable in cable assemblies 28 and 92 may be ½-inch or ⅝-inch diameter cable. The loops, or curves formed, such as noted at *66c, 66d, 66e,* may be approximately 42 inches in diameter, and bar 70 may be in excess of 5 feet long. The spacing between indentations in a pair, such as those noted at *72b, 72c,* may be approximately 14 inches, and the space between adjacent pairs such as *72c, 72d* may be approximately 4 inches. The fencing connectors 110 are manufactured of 12-gauge steel material with 5/16-inch nuts and bolts securing them in place.

When the device is set up as previously described, the friction-brake U-bolt devices in cable assembly 28 may be tightened to differing friction-holding capacities. For example, U-bolt friction-brake devices 76, 78, 84, 86, 88 may be tightened to 40 foot pounds of torque, whereas friction-brake devices 80, 82 may be tightened only to 35 foot-pounds of torque. This allows variable release of different parts of the system which may be advantageous.

Describing operation of the device, and referring to FIG. 3, a large rock, or boulder, 116 is indicated rolling down incline 120 toward fence 10. When it impacts the chain link fencing 104, the initial energy-absorbing characteristic of the fence will cause the fencing to stretch somewhat to absorb the initial impact of the boulder. Since the fencing is not tied tightly to the support posts, the fencing may move somewhat away from the posts as it stretches to absorb the initial impact shock. Further, since the fencing is mounted somewhat loosely on cable assemblies 28, 92 via connectors 110, the fencing is allowed to stretch on its own, somewhat independently of the cables and posts.

After the initial shock-absorbing tensioning of the fencing has occurred, tension will be imparted to cable assemblies 28, 92. Somewhat the same action will occur in both cable assemblies 28, 92 and thus only that in assembly 28 will be described in detail. As the cable assembly is placed under tension which exceeds the friction holding forces of selected U-shape friction-braking devices in the cable assembly, one, or all, of the loops, or curves *66c, 66d, 66e* will begin to shift toward a straighter line configuration. As this occurs, since the U-bolt friction-braking devices are maintained at set, preselected spacing there is room for the loop sections to move from curved to straight-line configuration without kinks occurring therein. Thus, the cable assembly provides a substantial amount of release capability in the loops of cable which may move from their looped toward a straight configuration as the wire fencing is impacted.

Generally a first shock load produced by an initial rock fall will not be sufficient to take all of the curves out of loops *66c, 66d, 66e.* Therefore, additional stored reserve capacity will be available for subsequent impact loading prior to maintenance being required on the fencing system.

If substantial shock loading occurs on the fencing system, to the point where it has no further reserve capacity for absorbing shock loads, it is a simple matter to remove and replace the damaged, or extended, chain link fencing by release of connectors 110. Releasing the frictional braking U-bolt assemblies allows the upper and lower cable assemblies 28, 92 to be drawn back into the loop curves of their operational configuration as illustrated in FIG. 2.

Thus it will be seen that a novel and efficient impact-absorbing fence is provided which is manufactured with economically available materials.

While a preferred embodiment of the invention has been described herein, it should be apparent that variations and modifications are possible without departing from the spirit of the invention that is set out in the appended claims.

I claim:

1. An impact fence comprising a substantially planar expanse of chain link fencing adapted to resist an impact load;

an anchor;

an elongate cable assembly connected to said anchor and extending adjacent to said expanse of fencing and connected thereto to assist in resisting an impact load, the cable assembly including a cable section having an intermediate portion formed in a loose curve; and friction-braking mechanism comprising a pair of friction clamp devices engaging said cable section outside opposite sides of the loose curve of said intermediate portion, and a holding device to which said clamp devices are connected to maintain a selected spacing therebetween, said clamp devices being selectively adjustable to control shifting of the intermediate portion from its curved toward a straight configuration upon an impact load being exerted on the fencing.

2. The fence of claim 1, wherein said holding device comprises an elongate substantially rigid member extending between said clamp devices.

3. The fence of claim 2, wherein said rigid member comprises an elongate bar having openings for receiving portions of said clamp devices and restricting movement of the clamping devices longitudinally of the cable assembly.

4. The fence of claim 3, wherein a clamp device comprises a bolt, and said opening in the bar receives the bolt therein.

5. The fence of claim 1, which further comprises a plurality of upright support posts, said cable assembly extends between and is connected to said support posts, and said chain link fencing is connected to and supported on said cable assembly in a substantially upright position.

6. The fence of claim 5, wherein said cable assembly extends along and is connected adjacent the top of said chain link fencing, and which further comprises a second cable assembly extending along and connected to said posts and fencing adjacent the bottom of said chain link fencing.

7. An impact fence comprising a substantially planar expanse of chain link fencing adapted to resist an impact load;

an elongate cable assembly extending adjacent and parallel to said expanse of fencing and connected thereto to assist in resisting an impact load, the cable assembly including a cable section having a first portion of which is formed in a first loose curve and a second portion which is formed in a second loose curve spaced from said first curve;

an anchor secured in a stable position spaced from said fencing to which an end portion of said cable assembly is secured; and friction-braking mechanism comprising a first pair of spaced-apart friction clamp devices engaging said cable section outside opposite sides of said first curve, a second pair of spaced-apart friction clamp devices engaging said cable section outside opposite sides of said second curve, and a holding device to which said first pair and second pair of clamp devices are connected to maintain a selected spacing between said clamp devices in each pair and a selected spacing between said first and second pairs, said clamp devices being selectively adjustable to control extension of the first and second cable portions from curved toward straight configuration upon an impact load being exerted on the fencing.

8. The fence of claim 7, wherein said holding device comprises an elongate substantially rigid member extending between said clamp devices.

9. The fence of claim 8, wherein said rigid member comprises an elongate bar having openings for receiving portions of said clamp devices and restricting movement of the clamping devices longitudinally of the cable assembly.

10. The fence of claim 9, wherein a clamp device comprises a bolt, and said opening in the bar receives the bolt therein.

11. The fence of claim 7, which further comprises a plurality of upright support posts, said cable assembly extends between and is connected to said support posts, and said chain link fence is connected to and supported on said cable assembly in a substantially upright position.

12. An impact fence comprising:

a substantially planar expanse of chain link fencing adapted to resist an impact load;

an anchor;

an elongate cable assembly connected to said anchor and extending adjacent to said expanse of fencing and connected thereto to assist in resisting an impact load, the cable assembly including a first cable section having an intermediate portion formed in a loose curve and a second cable section extending adjacent and parallel to the first cable section; and friction-braking mechanism comprising a pair of friction clamp devices engaging and interconnecting said cable sections outside opposite sides of the loose curve of said intermediate portion, and a holding device to which said clamp devices are connected to maintain a selected spacing therebetween, said clamp devices being selectively adjustable to control shifting of the intermediate portion from its curved toward a straight configuration upon an impact load being exerted on the fencing, with one of said cable sections being secured to said anchor.

13. An impact fence comprising:

a substantially planar expanse of chain link fencing adapted to resist an impact load;

an anchor;

an elongate cable assembly connected to said anchor and extending adjacent to said expanse of fencing and connected thereto to assist in resisting an impact load, the cable assembly including a cable section having an intermediate portion formed in a loose curve;

friction-braking mechanism comprising a pair of friction clamp devices engaging said cable section outside opposite sides of the loose curve of said intermediate portion, and a holding device to which said clamp devices are connected to maintain a selected spacing therebetween, said clamp devices being selectively adjustable to control shifting of the intermediate portion from its curved toward a straight configuration upon an impact load being exerted on the fencing; and a plurality of spaced-apart connectors loosely mounted on said cable assembly for shifting longitudinally therealong, with said chain link fencing secured at spaced points along its expanse to said connectors.

14. The fence of claim 13, wherein said connectors are releasable connectors permitting removal and replacement of an expanse of chain link fencing on said cable assembly.

15. An impact fence comprising:

a substantially planar expanse of chain link fencing adapted to resist an impact load;

an anchor;

an elongate cable assembly connected to said anchor and extending adjacent to said expanse of fencing and connected thereto to assist in resisting an impact load, the cable assembly including a cable section having a first intermediate portion formed in a first loose curve and a second intermediate portion formed in a second loose curve spaced from said first-mentioned curve; and friction-braking mechanism comprising a first pair of friction clamp devices engaging said cable section outside opposite sides of the first loose curve and a second pair of friction clamp devices engaging said cable section outside opposite sides of said second loose curve, and a holding device to which said clamp devices are connected to maintain a selected spacing between said clamp devices in said first and second pairs and to maintain a selected spacing of said second pair from said first pair of clamp devices, said clamp devices being selectively adjustable to control shifting of the first and second intermediate portions from curved toward straight configuration upon an impact load being exerted on the fencing.

16. The fence of claim 15, wherein said first-mentioned and second clamp devices are adjusted to different frictional holding capacities to allow movement of cable portions therebetween at different impact loadings of said fencing to provide sequential extension of the cable portions from their curved toward straight configurations upon loading.

17. An impact fence comprising:

a substantially planar expanse of chain link fencing adapted to resist an impact load;

an elongate cable assembly extending adjacent and parallel to said expanse of fencing and connected thereto to assist in resisting an impact load, the cable assembly including a first cable section having a first portion which is formed in a first loose curve and a second portion which is formed in a second loose curve spaced from said first curve, and a second cable section extending adjacent and parallel to non-curved portions of the first cable section;

an anchor secured in a stable position spaced from said fencing to which an end portion of said second cable section is secured; and friction-braking mechanism comprising a first pair of spaced-apart friction clamp devices engaging and interconnecting said cable sections outside opposite sides of said first curve, a second pair of spaced-apart friction clamp devices engaging said first cable section outside opposite sides of said second curve, and a holding device to which said first pair and second pair of clamp devices are connected to maintain a selected spacing between said clamp devices in each pair and a selected spacing between said first and second pairs, said clamp devices being selectively adjustable to control extension of the first and second cable portions from curved toward straight configuration upon an impact load being exerted on the fencing.

18. An impact fence comprising:

a substantially planar expanse of chain link fencing adapted to resist an impact load;

an elongate cable assembly extending adjacent and parallel to said expanse of fencing and connected thereto to assist in resisting an impact load, the cable assembly including a cable section having a first portion of which is formed in a first loose curve and a second portion which is formed in a second loose curve spaced from said first curve;

an anchor secured in a stable position spaced from said fencing to which an end portion of said cable assembly is secured;

friction-braking mechanism comprising a first pair of spaced-apart friction clamp devices engaging said cable section outside opposite sides of said first curve, a second pair of spaced-apart friction clamp devices engaging said cable section outside opposite sides of said second curve, and a holding device to which said first pair and second pair of clamp devices are connected to maintain a selected spacing between said clamp devices in each pair and a selected spacing between said first and second pairs, said clamp devices being selectively adjustable to control extension of the first and second cable portions from curved toward straight configuration upon an impact load being exerted on the fencing; and a plurality of spaced-apart connectors loosely mounted on said cable assembly for shifting longitudinally therealong with said chain link fencing secured at spaced points along its expanse to said connectors.

19. The fence of claim 18, wherein said connectors are releasable connectors permitting removal and replacement of an expanse of chain link fencing on said cable assembly.

20. An impact fence comprising:

a substantially planar expanse of chain link fencing adapted to resist an impact load;

an elongate cable assembly extending adjacent and parallel to said expanse of fencing and connected thereto to assist in resisting an impact load, the cable assembly including a cable section having a first portion of which is formed in a first loose curve and a second portion which is formed in a second loose curve spaced from said first curve;

an anchor secured in a stable position spaced from said fencing to which an end portion of said cable assembly is secured; and friction-braking mechanism comprising a first pair of spaced-apart friction clamp devices engaging said cable section outside opposite sides of said first curve, a second pair of spaced-apart friction clamp devices engaging said cable section outside opposite sides of said second curve, and a holding device to which said first pair and second pair of clamp devices are connected to maintain a selected spacing between said clamp devices in each pair and a selected spacing between said first and second pairs, said clamp devices being selectively adjustable to control extension of the first and second cable portions from curved toward straight configuration upon an impact load being exerted on the fencing, with said first and second clamp devices being adjusted to different frictional holding capacities to allow movement of cable portions therebetween at different impact loadings of said fence to provide sequential extension of the cable portions from their curved toward straight configurations upon loading.

* * * * *